US007982407B1

(12) United States Patent
Larimer

(10) Patent No.: US 7,982,407 B1
(45) **Date of Patent: *Jul. 19, 2011**

(54) STROBOSCOPIC ILLUMINATOR

(76) Inventor: Roy Larimer, Richmond, VA (US)

( * ) Notice: Subject to any disclaimer, the term of this patent is extended or adjusted under 35 U.S.C. 154(b) by 1492 days.

This patent is subject to a terminal disclaimer.

(21) Appl. No.: 11/406,997

(22) Filed: Apr. 18, 2006

Related U.S. Application Data

(63) Continuation-in-part of application No. 10/865,418, filed on Jun. 10, 2004, now Pat. No. 7,030,571.

(60) Provisional application No. 60/707,141, filed on Aug. 10, 2005.

(51) Int. Cl.
*H05B 37/00* (2006.01)

(52) U.S. Cl. ..... 315/241 P; 315/200 A; 315/241 S; 362/6

(58) Field of Classification Search ..... 315/241 P, 315/241 S, 200 A, 261–263, 200 R, 203, 315/204; 362/3, 6, 11, 12
See application file for complete search history.

(56) References Cited

U.S. PATENT DOCUMENTS 3,914,648 A * 10/1975 Friedman et al. ..... 315/241 P
4,155,029 A * 5/1979 Yamaoka ..... 315/151
4,167,669 A * 9/1979 Panico ..... 250/432 R
5,381,075 A * 1/1995 Jordan ..... 315/200 A
5,568,007 A * 10/1996 Yamura et al. ..... 313/35
5,842,047 A * 11/1998 Ogura et al. ..... 315/241 P
5,945,790 A * 8/1999 Schaefer ..... 315/112
6,229,272 B1 * 5/2001 Root ..... 315/112
6,867,547 B2 * 3/2005 Dunisch ..... 313/594
2002/0131555 A1 * 9/2002 Fleming et al. ..... 323/355

* cited by examiner

*Primary Examiner* — Jacob Y Choi
*Assistant Examiner* — Ephrem Alemu
(74) *Attorney, Agent, or Firm* — Steven M. Hoffberg; Ostrolenk Faber LLP

(57) ABSTRACT

A photographic illumination system, comprising a first stroboscopic flash tube, for emitting an intense broadband illumination pulse comprising ultraviolet rays; a second stroboscopic flash tube, for emitting a continuous series of broadband illumination pulses comprising ultraviolet rays; an optional filter, within a common optical path of the first and second stroboscopic flash tubes, for filtering a portion of the broadband illumination; and a control, for synchronizing the illumination pulse of the first stroboscopic flash tube with an external trigger pulse, wherein the second stroboscopic flash tube provides an output suitable for use by a human, unaided by viewing accessories, to compose a subject at a distance from the first and second stroboscopic flash tubes, and the first stroboscopic flash tube provides an output pulse suitable for exposure of an image capture medium. Both tubes are preferably manufactured to maintain the same spectral signature by adjusting fill pressure and gas mixture, and envelope material.

19 Claims, 3 Drawing Sheets

STROBOSCOPIC ILLUMINATOR

RELATED APPLICATIONS

The present application claims benefit of priority from U.S. Provisional Patent Application 60/707,141, filed Aug. 10, 2005, and is a Continuation-In-Part of U.S. patent application Ser. No. 10/865,418, filed Jun. 10, 2004, now U.S. Pat. No. 7,030,571 Apr. 18, 2006.

FIELD OF THE INVENTION

The present invention relates to the field of stroboscopic illumination sources for image capture, more particularly to systems and methods for providing illumination over a range of wavelengths, particularly for application in the fields of forensic and industrial imaging.

BACKGROUND OF THE INVENTION

It is well known to employ ultraviolet (UV) light in the field of photography in order to image objects that react by fluorescing at specific wavelengths in the UV spectrum. Typically, these light sources are mercury vapor lamps, due to their strong emission peaks in the UV region. In order to increase signal to noise ratio of the fluorescence signal, a standard UV band pass filter is placed in front of the light source, allowing only the desired wavelength (e.g., the $\lambda$ max absorption for fluorescence) of light to pass, reducing the effective output energy of the lamp significantly. This type of photographic arrangement often requires long exposure times, in excess of 5 seconds, making digital photography impractical, and further requires a photographic field which is maintained in the absence of ambient visible light. These limitations severely restrict the photographer in the type of camera that can be employed and location(s) he or she can operate within.

A popular method of imaging fingerprints on non porous items is as follows: The object is placed in an air tight container, preferably a vacuum chamber, along with a small container containing cyanoacrylate (super glue), the cyanoacrylate is heated until it starts to out-gas, and the resulting fumes attach to the oil left on the object by the fingerprint. Some prints will be visible to the unaided eye with this method, however faint or very light prints require a second step. The second step is to treat the object with the fumed prints to a coating of Basic yellow 40. Basic yellow 40 is a textile dye that is used to stain cyanoacrylate treated fingerprints on non-porous surfaces. The dye is also known as Maxillon Brilliant Flavine, Brilliant Yellow and Panacryl Brilliant Yellow. Stained fingerprints appear yellow when viewed under blue (450 nm) light sources. The object is then viewed under illumination of a 450 nm light source, through a KV 550 nm viewing filter.

Typical crime scene and laboratory ultra violet light sources direct a full spectrum light through a fiber optic conduit of quartz glass or a liquid light guide, and utilize a variety of interchangeable band pass filters between the light source and the light guide's input or common end. This permits only a relatively small field of illumination from a light guide of 0.5 inch diameter, and is designed primarily for observation.

The individual prints are selected, then composed and focused on, through the camera. The exposures are long, for example 5 seconds to 15 minutes, based on the amount of dye fluorescence, which is in turn dependent on the intensity of blue or UV light. To maximize the effect the area needs to be very dark, and using UV light for illumination limits visible interference.

Repetitive pulse operation of xenon light sources is known, for example as stroboscopes, red-eye reduction preflash, sterilization, and for other illumination purposes.

See www.xenon-corp.com/sterilization.html, www.chem.helsinki.fi/~toomas/photo/flash.html; www.chem.helsinki.fi/~toomas/photo/flash-discharge.html; www.chem.helsinki.fi/~toomas/photo/flash-discharge/redwait.html; www.chem.helsinki.fi/~toomas/photo/flash-discharge/set-up.html; www.chem.helsinki.fi/~toomas/photo/flash-discharge/regular.html; www.chem.helsinki.fi/~toomas/photo/flash-discharge/hispeed.html; members.misty.com/don/samflash.html; and www.photozone.de/3Technology/flashtec5.htm, each of which is expressly incorporated herein by reference in its entirety.

SUMMARY OF THE INVENTION

The present invention allows the photographer to view a treated object and compose a photograph and focus, with a "modeling lamp", and then to capture an image at the camera's fastest flash sync speed, with a flash duration of $1/1000$ sec or less.

Preferably, the modeling lamp has an output spectrum which is similar to the output of the primary flash, and both have emissions within the UV range. Both the modeling lamp and primary flash may be flash tubes, with the modeling lamp operated at a relatively high repetition rate, e.g., greater than about 30 pulses per second, and more preferably between about 30-60 pulses per second, within a range that the human eye perceives to be continuous illumination and which remains pulsatile in operation.

The intensity or amplitude of the light output is governed by the time-intensity product of the flash. The intensity, in turn is governed by the voltage and current across the flash lamp. Typically the energy for operating the lamp is stored in a capacitor prior to triggering. The intensity of the primary flash is synchronized to the imaging camera, and is of sufficient amplitude and short duration to permit the photography of UV fluorescent materials in ambient room or daylight, and given the reduced exposure time, digital cameras may be used instead of film with excellent results. In order to obtain suitable and visible emissions in sunlight, the emission of the fluorescent material may be, for example, at least 1% of the solar intensity, preferably brighter. Assuming full absorption by the dye and that the fluorescent efficiency is 1%, the brightness of the modeling lamp, at the subject, should be 1 sun, which is approximately 100 Watt-seconds. Xenon flash tubes approximate solar irradiation in spectral distribution; therefore assuming a radiation area of 1 square meter at the subject distance, this implies a xenon flash output of 100 Watt-seconds as well. The primary flash is typically far brighter, for example having a maximum intensity of about 2400 Watt-seconds maximum. This is achievable within standard operating practices for xenon pulse illumination systems, and new technologies are not required to generate the driving waveform for the flash tube of either the primary or modeling flash lamp systems. Likewise, other than ensuring that the flash tube envelope does not absorb UV light, for example using a quartz glass tube, the flash lamp tubes are also of relatively standard designs. In order to increase the signal to noise ratio of the fluorescence, a UV bandpass filter with visible light cutoff is preferred. Suitable dichroic filters for this purpose are available, but care must be exercised to ensure that they are capable of withstanding the light output, especially the sustained modeling light illumination.

When an alternate filter is used, in the 320 to 370 nm range, bite marks and bruises not visible to the unaided eye become apparent. Penetration and reflection of light on the skin is a function of wavelength. Shorter wavelengths such as UV do not penetrate the skin very far before they are reflected back to the camera. Therefore, a high resolution picture of the skin surface is possible. This works well for bite marks, cuts, scratches and scars, without the need of a special controlled lighting environment.

In a first embodiment of the present invention, two full spectrum xenon light sources, with substantial optical output power from 220 nm to 800 nm are employed, which are then filtered to pass the desired wavelengths, e.g., UV. Since the xenon light sources are intrinsically broadband, in principal any UV, visible, or near infrared wavelengths can be selected.

The preferred lamp is a flash tube comprising a xenon gas within a space, which is electrically excited to emit a broadband optical emission between about 220-800 nm, inside a UV transmissive tube, having an electrode at each end of the tube and a trigger electrode outside of the tube in proximity to one of the electrodes. Strobe intensity is generally governed by the time-intensity product of the flash. The intensity, is governed by the voltage and current across the flash lamp. The spectral output may be somewhat sensitive to the current density and driving waveform. Typically, the energy for the flash lamp is stored in a capacitor prior to triggering. The static voltage across the capacitor (and the electrodes in the xenon-filled tube) is insufficient to ionize the xenon gas within the tube, so a substantially higher potential trigger pulse, through the trigger electrode, is provided to commence the flash cycle by initially ionizing the gas, increasing its conductivity so that the capacitor charge (or a portion of the charge) is discharged through the tube. The flash cycle can be terminated in two ways. First, the energy stored in the capacitor can be fully discharged, until the flash lamp no longer sustains conduction, or a high voltage semiconductor or switch (e.g., a thyristor) can terminate the current flow in advance of full discharge.

Because the xenon flash lamp has relatively constant output characteristics over the duration of the flash cycle, especially if electrode voltage remains relatively constant, a relatively constant color temperature, that is, a distribution of light wavelengths in the emission spectrum, is maintained, regardless of flash duration. This allows relatively independent control over flash duration, and therefore total illumination intensity, and spectral distribution of the flash output. By terminating the flash cycle prior to complete discharge of the capacitor, voltage variations on the electrodes, and current variations through the tube, are reduced, also serving to maintain a consistent color temperature. In order to permit orders of magnitude range of operation, a plurality of capacitors may be provided in a bank, with some or all of the capacitors selected for discharge in a given cycle. In this manner, flash duration over a large range may be supported with relatively controlled spectral characteristics.

In order to adequately illuminate the target for UV fluorescence, an unobstructed or reflected optical path for the UV light from the tube is provided extending from the tube to a target location.

In a preferred embodiment, two xenon flash tubes are provided. The first xenon flash tube is the primary flash tube, and is used for imaging, that is, principal illumination of the subject during exposure of the image recording medium. The second xenon flash tube is the modeling lamp, and is used for photo composition and focusing.

The preferred system employs a flash controller which employs multiple capacitors for the primary flash tube, which are selected based on an anticipated flash power requirement. Typically such multiple capacitor systems also provide a semiconductor switch (a thyristor) to terminate the flash cycle in a controlled manner, and therefore allowing even finer control over the light output. It is noted that in such systems, the desired light output range must be set in advance. In a preferred embodiment of the invention, a DynaLite 2000DR flash power pack is used to power the xenon primary flash tube. For example, by scaling the capacitor to the desired illumination output, the variations in flash spectral distribution may be normalized, and so provide consistency in captured images.

Alternately, a flash power pack providing up to about 2400 Ws output, 50/60 Hz, 120/240 VAC operation may be used.

The first xenon flash tube pulse output is synchronized, by timing of the trigger pulse, to the imaging camera, and emits illumination of sufficient amplitude (within the band of interest) and short duration to permit the photography of UV fluorescent materials in ambient room or daylight.

The second flash tube, the modeling lamp, is similar in construction to the first xenon lamp, although suited to relatively high repetition rates and relatively low power for each pulse. This second xenon flash lamp is intended to provide sufficient illumination to allow a human observer, typically unaided by viewing equipment, to observe the illumination effects, and so compose the image for capture. Ergonomically, it is preferred that this illumination appear to be continuous. Therefore, pulse repetition rates over 30 cycles per second (cps), and preferably between 30-60 cps, and up to about 100 cps, are provided. Advantageously, the pulse repetition may be synchronized with the line frequency, to avoid oscillation from ambient lighting. Under these conditions, to a human observer, the illumination appears constant, even though it is generated as a pulsatile waveform. At these repetition rates, certain modifications to the system are preferred as compared to traditional flash systems. The second xenon flash tube is mounted in such a way that it uses the same reflector and optical pathway as the "imaging lamp", i.e., the first xenon flash tube. It is powered by means of circuitry and software to control both intensity and pulse frequency. The trigger capacitor preferably stores more energy than a typical trigger circuit, for example having a 0.1 μF capacitor, delivering 4 mJ energy, instead of a more typical 0.02 μF capacitor. In addition, the xenon fill pressure in the flash is preferably higher than normal, for example 135 mm Hg as compared to a more typical 60 mm Hg. This increased fill pressure is believed to help cool the electrodes, and thereby ensure stable triggering of the second flash tube. While these modifications can result in a warmup time of a few seconds, it allows extended operation without misfires.

The second flash tube, though dissipating a lower power per pulse than the first flash tube, can generate a large amount of heat during extended operation. Therefore, it is preferred that special construction and cooling be provided to permit extended operation at full power.

The helical coil of the quartz tube, as shown in FIG. 3A, provides gaps between the envelope to enhance cooling. The second flash tube is also provided with a continuous flow of air from a high flow, high pressure-type fan, which for example, provides a flow through the center of the ceramic socket. Typically, a cooling fan for an electronic enclosure provides a relatively low back pressure flow over a large cross section, to yield a high cubic foot per minute flow rating. However, in order to cool a stroboscopic lamp, a more focused flow over a smaller cross section is preferred, in which the fan may be subject to significant flow obstructions (back pressure).

The electrodes of the lamp are metallic, and may begin to glow from the heat after extended use. A particularly preferred embodiment provides a ducted reflector which both reflects the flash illumination forward while directing cooling air toward the lamp, and in particular the ends of the lamp. Likewise, the electrode is typically surrounded externally with a ceramic shield, which, though heat resistant, is fragile and may be subject to stress due to thermal expansion. This ceramic may be provided with a central aperture, through which the cooling air flow is ported, to facilitate convectional heat removal from the ceramic fixture and metal electrodes.

By providing an enhanced construction of the tube, as well as specially adapted cooling of the enclosure, extended (e.g., continuous) operation at full power, e.g., 100 Ws, 60 Hz, is possible. It has been found that without these adaptations, the second flash tube is limited to full power operation, e.g., greater than about 100 Watt-seconds for less than 90 seconds before misfires occur, likely due to increased electrode impedance, while with improved construction and cooling, misfires do not generally occur after warmup.

The primary stroboscopic flash tube is preferably excited at a power of at least 125 Watt-seconds and the modeling stroboscopic tube is preferably excited at a power of at least 25 Watt-seconds. One option is to provide a battery power source, such as a deep-discharge lead-acid marine battery, allowing field use without line power.

Another option employs a fiber optic light conduit for illuminating the subject. This arrangement is especially advantageous for heat sensitive subjects. The fiber optic light conduit preferably receives at least 25% of the optical output of the first and second stroboscopic flash tubes. The fiber optic may be, for example, a bundle of fused silica fibers or a liquid core light conduit.

The flash tube envelopes of both the primary and secondary flash tubes are preferably quartz glass designed to transmit the UV light and deliver very similar spectral signatures. This insures that the modeling lamp will emulate the photonic characteristics of the primary flash lamp that is used for the image acquisition. In some cases, even better spectral matching is desired. For example, the difference in energy, as well as the effective driving waveform, of the modeling illumination and primary flash illumination may result in slight differences in color. These may be corrected by a coating or filter on the quartz envelope of one or both lamps, or by way of filter(s) in the light path.

The abundance of illumination produced by this means also allows the photographer to stop down the lens, in order to gain much needed depth of field, in most instances, while maintaining a very fast shutter speed. Typically, a flash synchronization shutter speed is between 1/60-1/1000 sec.

The light source according to a preferred embodiment of the present invention uses a flash head and reflector of 4.5 inch diameter, enabling it to cover a broad physical space at a generous working distance. The modeling lamp has proven to function (i.e., to visibly excite fluorescent material) in ambient room light, and even daylight, proving itself as a superior observation tool as compared to the traditional UV illuminator system.

A UV band pass filter is placed in the optical path, i.e., in the forward path of the optical rays toward the subject, in front of the flash tubes and reflector. The UV filter is designed to be interchangeable, and one preferred option allows for a broader band than most commercially available filters. A preferred filter allows a pass wavelength of 445 to 465 nm, which is suitable to excite a range of common materials. A blocking filter may also be used over the camera lens to block this specific wavelength preventing reflected ultra violet light from adversely affecting the image. This 445-465 nm wavelength is commonly used in forensics to render treated finger prints and to create contrast on fabrics that have been subjected to "brighteners" in the wash.

Preferably, the stop band of the filter limits UV-B rays in the band 280-320 nm, while substantially passing UV-A rays between 330-465 nm. In particular, it is preferred that the illuminator, if used for forensic purposes, not emit UV-B rays which would form dithymidine, and thus impair DNA recovery. Since the illuminator can be quite bright, substantial filtering may be required. The filter must therefore be designed to handle a high heat load, since a substantial amount of energy may be absorbed by the filter during operation, both due to proximity to the flash lamps, and due to absorbed energy in the stop band(s).

The band pass filter is typically provided within a tubular structure which is attached at its near edge to the stroboscopic housing, near the front, so as to filter substantially all of the light exiting the housing. Thus tubular structure can be readily removed from the housing, for example to exchange filters or to access the flash lamps. The stroboscopic housing is provided with baffles to allow air flow to cool the flash lamps, while preventing stray light from exiting the housing without passing through the filter.

Typical dichroic filters currently used in the industry require serial stacking of multiple glass filters to obtain the desired effect, i.e., a UV band pass filter doubled to an IR reflecting filter added to heat absorbing glass. This results in a significant loss of light. The preferred embodiment of the invention therefore employs a multicoated filter on a single substrate to achieve the desired optical characteristics. The preferred filters in accordance the present invention therefore employ a single glass or quartz substrate with multiple thin coatings, to achieve desired pass and stop band characteristics.

It is also possible to use a different filter in front of the flash tubes, that will block all visible and ultra violet emitted by the lamps, leaving only near IR for use in document and forgery analysis. This method is possible because different inks react differently to IR and near IR illumination, and because of the broad spectrum, high output available from a stroboscopic illuminator.

In a second embodiment, two commercially available camera strobes are modified by replacing the standard flash tubes (which typically are made of a glass which blocks UV rays) with quartz envelope tubes, also removing the plastic barrier covering the flash tube and adding the appropriate band pass filter. They are joined via a flash synchronization cord, and mounted together with a commercially available consumer digital camera. The combined power of the two synchronized units and the instant image preview capability of the digital camera, provides a portable field unit. A separate high pulse repetition rate stroboscopic illuminator, either in a separate module or mounted with one or both of the synchronized units, provides modeling illumination.

The repetitive pulse illuminator may also be used independently of the primary stroboscopic flash tube. That is, in situations where an intense ultraviolet illuminator is desired, the modeling lamp component of the present invention may be useful. Thus, another embodiment of the invention provides an ultraviolet illumination system, comprising a stroboscopic flash tube, for emitting a rapid series of broadband illumination pulses comprising ultraviolet rays, said series being sufficiently rapid to be perceived by the human eye as continuous illumination; and an a broadband optical filter having a passband and a stop band. This illuminator is more useful in conjunction with a filter, for example a filter passing at least 90% of the rays in a selected passband at least 10 nm wide, and reflecting at least 90% of the rays in a stopband at least 50 nm wide. Reflective filters are preferred, since optical absorption filters at this intensity tend to get very hot and may have limited life. On the other hand, dichroic filters, formed of a series of controlled layers placed on a substrate, to not absorb a large portion of the light, and therefore are preferred at higher power levels. By using a broadband light source, such as a xenon flash tube, there is significant flexibility in selecting an appropriate filter for a given task. Since the illuminator is intended for human visual use, the flash tube is preferably excited with pulses at a rate of greater than 30 pulses per second, and more preferably at a rate between 50-100 pulses per second, and most preferably at about 60 pulses per second. A reflective optic is preferably provided for directing the ultraviolet output of the stroboscopic flash tube, and may also serve other functions, for example filtering infrared radiation.

In a preferred embodiment, the filter passband is between 320 and 465 nm, and the filter stopbands are <200-320 nm and 490->700 nm. The upper stopband preferably extends well beyond 700 nm, for example to at least 800 nm. The lower stop band is naturally limited by the UV absorption of oxygen below 200 nm. For example, the 320 to 465 nm passband has a transmittance of at least 95%, and transmittance in the bands between 520 to 700 nm and 280 to 300 nm each are less than 5%.

The power pack for the stroboscopic illuminator system is preferably capable of operating from a variety of sources, for example 120-240 VAC, 50-60 Hz, and 12 VDC. The power pack preferably provides a peak power of 2400 Watt-seconds for the first flash tube (primary), and 100 Watt-seconds for the second flash tube (modeling light). Where necessary, a higher output of the second flash tube is possible, especially if short duration illumination is required, or if a further modified second flash tube is employed. In order to provide synchronization with line current. The trigger circuit for the modeling light preferably is switchable between 50 and 60 Hz, although other repetition rates are possible.

These and other objects will become apparent from a review of the Drawings and the Detailed Description of the Preferred Embodiments. For a full understanding of the present invention, reference should now be made to the following detailed description of the preferred embodiments of the invention as illustrated in the accompanying drawings.

BRIEF DESCRIPTION OF DRAWINGS

The invention will now be described with reference to the accompanying drawings, in which.

DETAILED DESCRIPTION OF THE PREFERRED EMBODIMENTS

Figure 1:
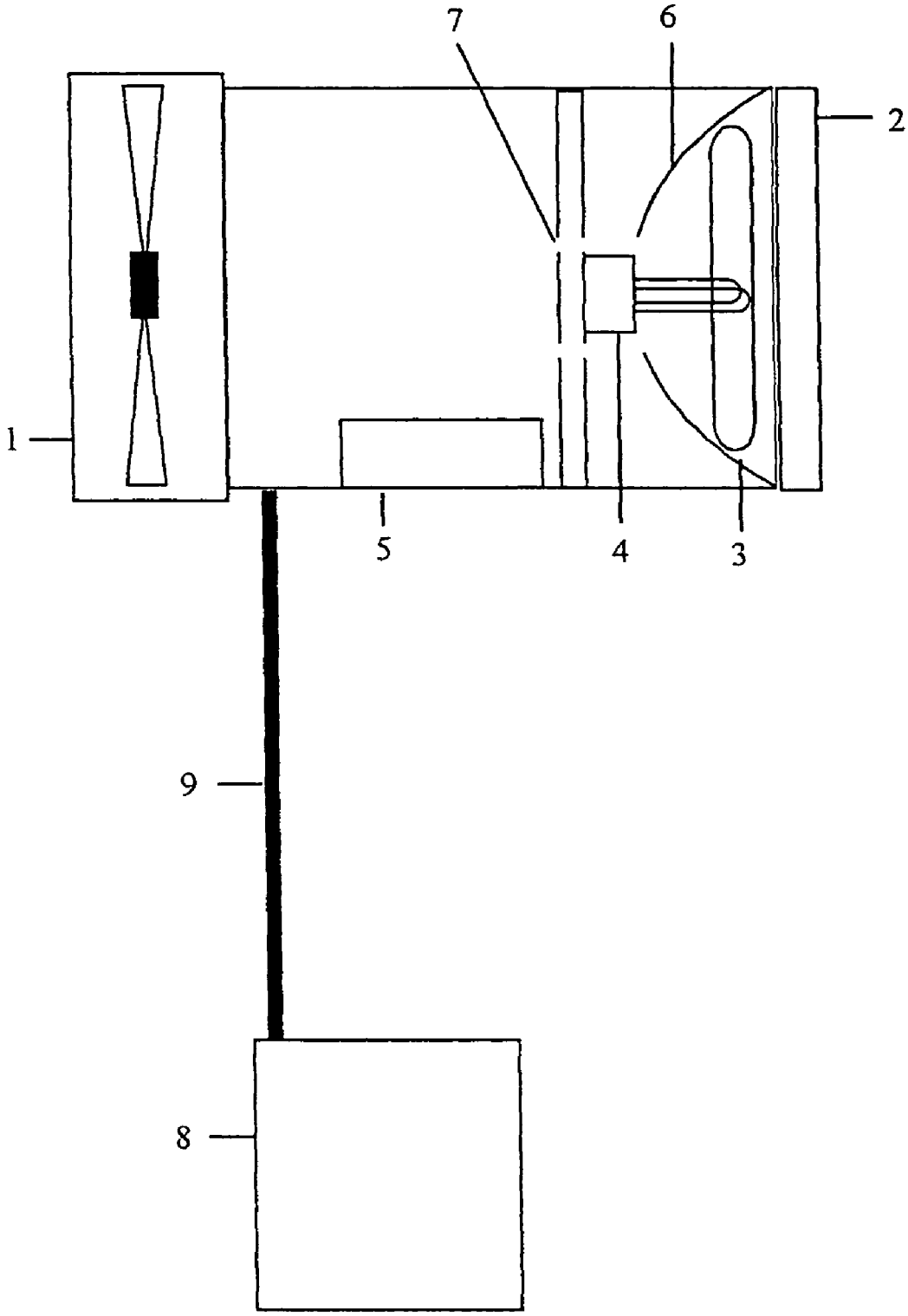
FIG. 1 shows a schematic representation of a cross section view of an embodiment according to the present invention.

As shown in FIG. 1, a high output AC or DC cooling fan 1 capable of delivering at least 50.0 CFM. The air is pushed from the rear of the housing towards the front, passing over the circuitry, prior to entering the directional ducting, which directs the air over the secondary flash tube 4 and through the heat sync/reflector 7.

A UV or IR band pass filter 2 is optionally mounted in the filter holder. A preferred filter includes a heat resistant quartz or glass substrate, bonded with a special coating that is calibrated to allow a specific band of wavelengths of light to pass, while blocking out other wavelengths. This filter is designed as a "quick change" unit. All filters are coated to specific wavelengths depending on the application.

Figure 2:
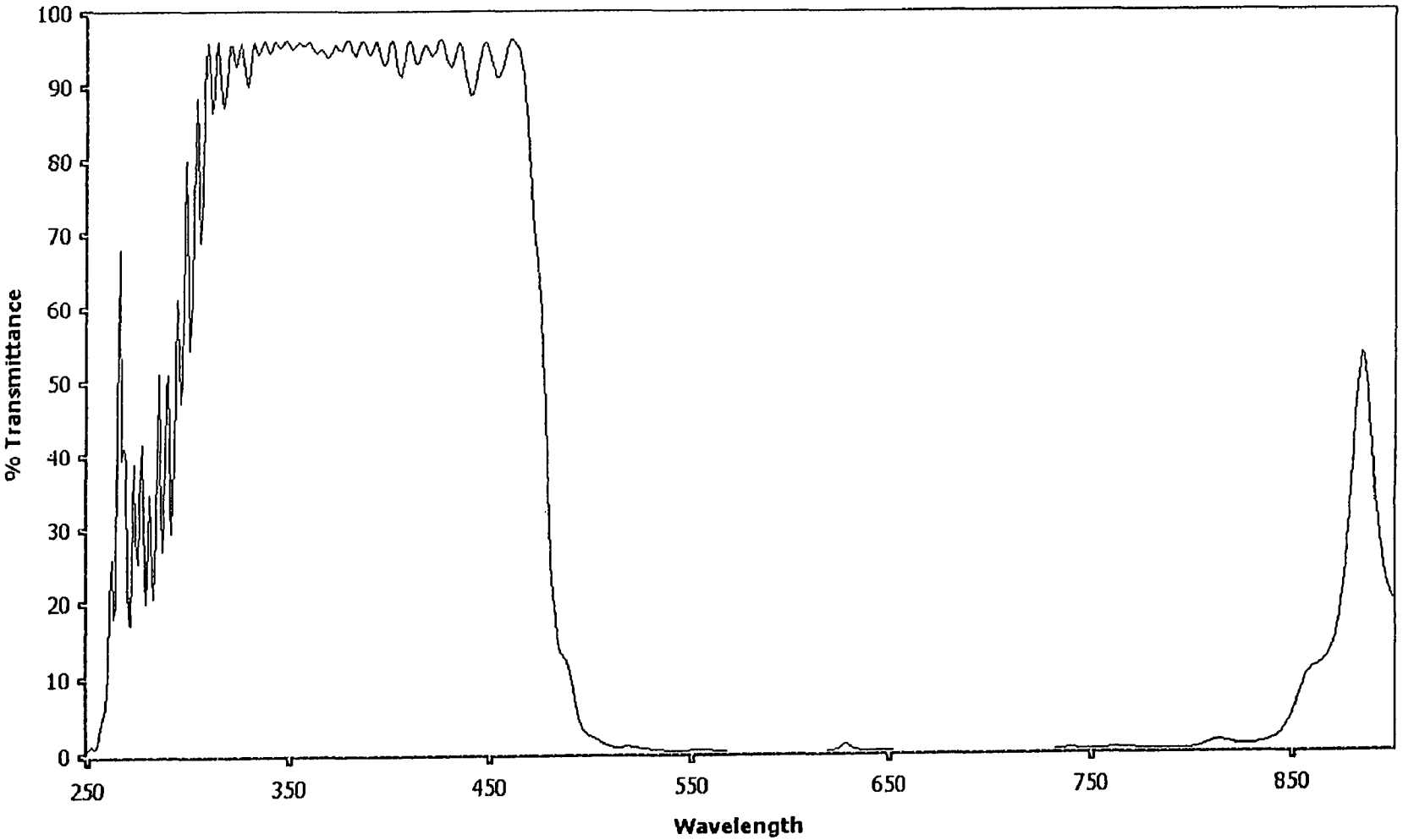
FIG. 2 shows a spectral transmittance of a preferred UV Filter used in accordance with the present invention.

FIG. 2 shows a spectral transmittance a very broad band UV filter suitable as the band pass filter 2, based on a quartz substrate glass and selective coatings numbering more than 70 layers, which allow a transmittance of a band from 290 nm to 490 nm, with IR blocked to 840 nm.

The primary flash tube 3, or imaging tube, is a flash tube comprising a gas (typically xenon) within a space, excited to emit a broadband optical emission between about 220-800 nm, inside a UV transmissive tube, having an electrode at each end of the tube and a trigger electrode outside of the tube in proximity to one of the electrodes. If UV illumination of the subject is desired, the optical path between the tube and subject should be free of substantially UV absorbing materials, such as soda lime glass or many plastics.

The secondary flash tube 4, or modeling lamp, is specifically designed to fire at a rapid rate with relatively low voltage. This is accomplished by reducing the fill pressure of the tube (which is also typically filled with xenon) to near zero. It is then excited to emit a broadband optical emission between about 220-800 nm, inside a UV transmissive tube, having an electrode at each end of the tube and a trigger electrode outside of the tube in proximity to one of the electrodes. The second flash tube is intended to correspond in output wavelength distribution to that of the first flash tube, therefore, it is advantageous for both tubes to employ a common optical path, at least to the extent reasonable. On the other hand, it is also possible to separate these tubes, if required.

The primary flash trigger circuit 5 provides mounts for the anode and cathode, as well as the trigger coil and trigger capacitor, for triggering the primary flash tube 3 to fire. It is in line with the air flow from the fan for maximum cooling.

The reflector 6 is machined out of solid aluminum and is over 1 inch thick, and therefore serves as an effective heat sink. It is angled at 42 degrees for the best possible dispersion of both the main and secondary flash tubes. The back of the reflector 6 body is opened up to accommodate the modeling lamp and to allow air flow through the reflector and over the flash tube itself. The entire circumference of the reflector 6/heat sink is sealed, forcing air current generated by the fan, through a baffle 7, to concentrate in the appropriate areas. The accumulated heat generated by the modeling lamp 4 and primary flash tube 3 is either convectively dissipated in the air flow, or absorbed by the aluminum reflector 6 and then dispersed through vent holes in the nose of the enclosure. A plurality of vent holes are provided, for example, around the housing of the flash head, in front of the flash tubes 3, 4, and behind the filter 2, with an appropriate baffle to limit light leakage.

The exhaust ports are located in the nose of the unit, and allow the hot air coming over the reflector and heat sink 6 and primary flash tube 3 and secondary flash tube 4 to the exit. There is a light baffle 7 inside to eliminate unwanted visible (and ultraviolet) light from escaping rearward.

The power supplies for both the primary and secondary flash tubes 8 are connected via separate power cords, which may be consolidated into the same physical cable 9.

The modeling lamp controller is, for example, incorporated into a Dyna-lite studio flash power pack model #2000DR controller for the primary flash, providing a common physical package external power lead interface for the two separate functions. A preferred modeling lamp controller is a modified Diversitronics ESM-DMX strobe unit, the power supply of which has been modified to include a special CPU and software, to enable it to pulse the modeling lamp at full power, at 60 cycles per second. The stock unit provides reduced intensity as pulse rate increases in an effort to extend tube life, and the modifications permit full intensity flashing. The present invention provides a cooling fan 1, in the illuminator housing, which achieves satisfactory lamp life, even when pushing the secondary flash tube 4 past its otherwise normal recommended maximum rating. The modeling lamp 4 is control circuit synchronizes the pulse to the frequency of the AC line current at 60 Hz.

This combination allows the photographer to locate and identify the fluorescing material in ambient room light and to image it using standard professional photographic film or by using a digital camera.

The DynaLite studio flash power pack model #2000DR uses multiple capacitors to deliver 2000 watt seconds of power in a single discharge. The length of the flash power cord 9 was shortened from 20 feet to 6 feet from a stock design in order to decrease the flash duration.

A preferred embodiment of the present invention, which includes a single flash unit, i.e., one 2000 Watt-second (WS) primary flash tube 3 and one secondary flash tube 4, using an optical filter 2 as described above, and power pack for primary and secondary flash tubes 8, is suitable for exposing a fingerprint with UV light, at a working distance of 10-15 feet between the flash unit to the fingerprint, using the fastest flash sync speed of a camera, e.g., 1/90-1/1000 second.

The modeling light 4 is used to allow composition of the exposure prior to primary flash tube 3 discharge, since it permits a long duration UV illumination of the subject, from the same location, i.e., using the same reflector 6, having a nearly identical spectral distribution.

Figure 3A:
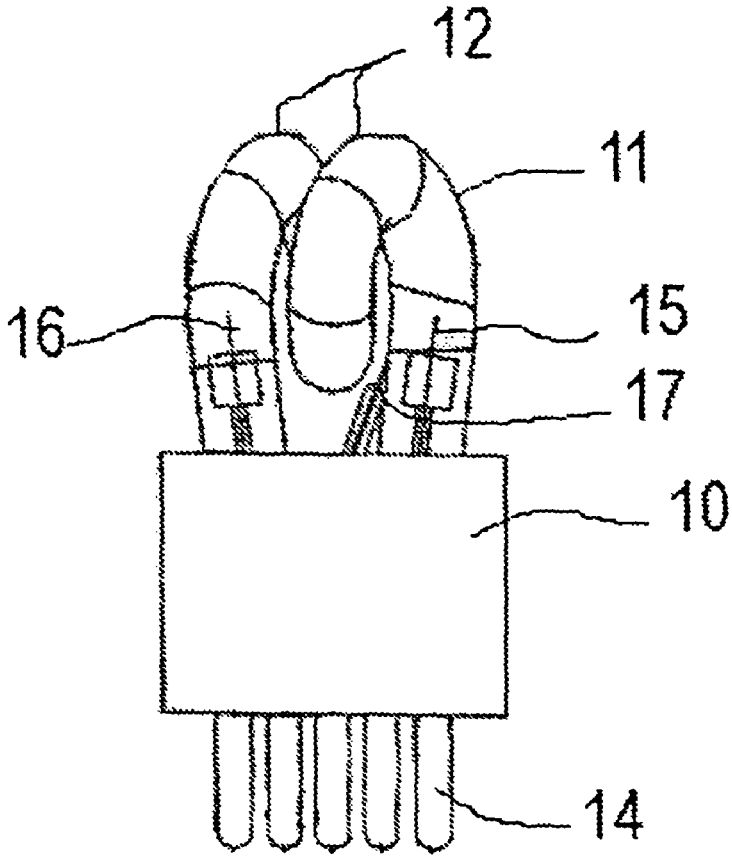
FIGS. 3A and 3B show a side and bottom view of the second flash tube.
Figure 3B:
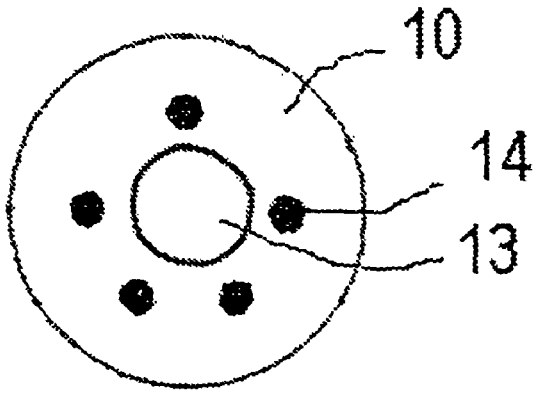

A preferred second flash tube is shown in FIGS. 3A and 3B. A ceramic base 10 supports a quartz envelope 11, which is formed in a helical spiral 12. The adjacent portions of the quartz envelope 11 are spaced to allow air circulation. The ceramic base 10 has a central aperture 13, which allows a flow of air from beneath the ceramic base 10 to convectionally cool the base 10, quartz envelope 11, and the other structures. A plurality of pins 14 pass through the through the ceramic base 10, which connect to the anode 15, cathode 16, and trigger 17 of the flash lamp. The quartz envelope 11 is filled with gas (e.g., xenon) to a pressure of about 130 mm Hg at room temperature.

There has thus been shown and described novel illuminators and novel aspects of illumination systems, which fulfill all the objects and advantages sought therefore. Many changes, modifications, variations, combinations, subcombinations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. An illumination system, comprising a base, a stroboscopic flash tube having a set of electrodes and an electrically excited gas contained within a helical envelope, both ends of the helical envelope being mounted to the base, configured to emit a continuous series of broadband illumination pulses synchronized with a line current oscillation comprising heat, visible and ultraviolet rays, wherein the heat is sufficient to cause an uncooled stroboscopic flash tube to have unstable operation over a continuous extended period; and a conduit through said base configured to supply, from a fan, a sufficient flow of cooling gas to cool at least the ends of the helical envelope of said stroboscopic flash tube to ensure stable operation over the continuous extended period, wherein said base is configured to serve as a heat sink for at least one electrode for exciting said stroboscopic flash tube, and said conduit is in thermal conduction with said at least one electrode, to thereby convectively transfer heat through a wall of said conduit to the cooling gas therewithin.

2. The system according to claim 1, wherein said flash tube is configured to be excited with pulses at a rate of about 50 pulses per second.

3. The system according to claim 1, wherein said flash tube is configured to be excited with pulses at a rate of about 60 pulses per second.

4. The system according to claim 1, wherein said stroboscopic flash tube is helically coiled, and wherein said conduit is configured to selectively direct a flow of cooling gas toward a central portion of said helically coiled stroboscopic flash tube.

5. The system according to claim 1, wherein said base comprises a ceramic.

6. The system according to claim 1, wherein said base comprises a ceramic socket having electrical connector pins extending therefrom.

7. The system according to claim 1, further comprising a fan configured to pressurize a cooling gas within said conduit to generate a high flow of the cooling gas directed toward said stroboscopic flash tube.

8. The system according to claim 1, wherein the stroboscopic flash tube comprises xenon gas.

9. A photographic illumination system, comprising:

(a) a first stroboscopic flash tube, configured to emit an intense broadband illumination pulse comprising ultraviolet rays, synchronized with an external trigger signal; and (b) a second stroboscopic flash tube, configured to emit a continuous series of broadband illumination pulses comprising visible and ultraviolet rays, said series of broadband illumination pulses being synchronized with a line current oscillation and being emitted at least prior to the external trigger signal, the first stroboscopic flash tube being configured to emit the intense broadband pulse having an intensity greater than an intensity of a single broadband illumination pulse of said second stroboscopic flash tube, the first and second stroboscopic flash tubes being configured to emit illumination having a substantially overlapping spatial illumination pattern.

10. The system according to claim 9, wherein the first stroboscopic flash tube is configured to provide an output pulse suitable for exposure of an image capture medium.

11. The system according to claim 9, further comprising an optical filter, within a common optical path of the first and second stroboscopic flash tubes, for filtering a portion of the broadband illumination.

12. The system according to claim 9, wherein the first and second stroboscopic flash tubes each comprise xenon gas.

13. The system according to claim 9, wherein said second stroboscopic flash tube is configured to be excited with pulses at a rate of greater than 30 pulses per second.

14. The system according to claim 9, wherein said second stroboscopic flash tube is configured to be excited with pulses at a rate of about 60 pulses per second.

15. The system according to claim 9, further comprising a fiber optic light conduit, said fiber optic light conduit being configured to receive at least 25% of the optical output of each of the first and second stroboscopic flash tubes.

16. The system according to claim 9, wherein said second stroboscopic flash tube comprises a base, a xenon-filled helically coiled stroboscopic flash tube, mounted on said base; and a conduit through said base for supplying a flow of cooling gas to cool said second stroboscopic flash tube by directing a flow of cooling gas toward a central portion of said helically coiled second stroboscopic flash tube, wherein said base comprises a ceramic socket having electrically conductive elements extending therefrom for exciting electrodes within said second stroboscopic flash tube, the ceramic socket being configured to serve as a heat sink for said electrodes, said conduit being in thermal conduction with said electrodes, to thereby convectively transfer heat through a wall of said conduit to the cooling gas therewithin, further comprising a fan configured to pressurize a cooling gas in said conduit to generate a high flow of the cooling gas directed toward said stroboscopic flash tube.

17. The system according to claim 9, wherein said first stroboscopic flash tube is configured to be excited at a power of at least 125 Watt-seconds and the second stroboscopic tube is configured to be excited at a power of at least 25 Watt-seconds.

18. The system according to claim 17, further comprising a battery power source configured to supply power for operation of the first stroboscopic flash tube and the second stroboscopic flash tube.

19. A photographic illumination method, comprising:

(a) emitting an intense broadband illumination pulse comprising ultraviolet rays, synchronized with an external trigger signal, from a first stroboscopic flash tube;

(b) emitting a continuous series of broadband illumination pulses comprising visible and ultraviolet rays synchronized with a line current oscillation, from a second stroboscopic flash tube having at least one electrode, said series being emitted at least prior to the external trigger signal; and (c) actively cooling the at least one electrode from an exterior of the second stroboscopic flash tube, the first stroboscopic flash tube having an intensity greater than said second stroboscopic flash tube, the first and second stroboscopic flash tubes emitting illumination having a substantially overlapping spatial illumination pattern.

* * * * *